US005954477A

United States Patent [19]

Balsdon

[11] Patent Number: 5,954,477

[45] Date of Patent: Sep. 21, 1999

[54] SEAL PLATE

[75] Inventor: Julian G Balsdon, Bristol, United Kingdom

[73] Assignee: Rolls-Royce plc, London, United Kingdom

[21] Appl. No.: 08/921,538

[22] Filed: Sep. 2, 1997

[30] Foreign Application Priority Data

Sep. 26, 1996 [GB] United Kingdom ..... 9620070

[51] Int. Cl.[6] ..... F01D 11/00; F03D 11/04; F04D 29/08

[52] U.S. Cl. ..... 416/95; 415/173.7; 416/193 A; 416/219 R; 416/220; 416/248; 416/320 R

[58] Field of Search ..... 415/173.7; 416/193 A, 416/219 R, 220 R, 248

[56] References Cited

U.S. PATENT DOCUMENTS

| | | | |
|---|---|---|---|
| 3,748,060 | 7/1973 | Hugoson et al. . | |
| 4,480,959 | 11/1984 | Bourguignon et al. . | |
| 4,820,116 | 4/1989 | Hovan et al. . | |
| 4,854,821 | 8/1989 | Kernon et al. . | |
| 5,173,024 | 12/1992 | Mouchel et al. | 416/220 R |
| 5,236,302 | 8/1993 | Weisgerber et al. | 415/173.7 |
| 5,275,534 | 1/1994 | Cameron et al. | 416/95 |
| 5,288,210 | 2/1994 | Albrecht et al. . | |
| 5,318,405 | 6/1994 | Meade et al. | 416/220 R |

FOREIGN PATENT DOCUMENTS 2012007 7/1979 United Kingdom .

*Primary Examiner*—Edward K. Look
*Assistant Examiner*—Rhonda Barton
*Attorney, Agent, or Firm*—Oliff & Berridge, PLC

[57] ABSTRACT

An annular seal plate for an interstage air riding seal arrangement for the internal cooling system of a gas turbine engine is mounted on a rotatable disc by means of an annular mortise and tenon mounting. The contact faces of the mortise and tenon are angled relative to a radial plane of the disc so that centrifugally generated forces are reacted by the faces in a sense to counter axial tilt so that a seal face of the plate lies exactly in a radial plane, at a design rotational speed, thereby to eliminate convergence or divergence between the seal faces of the air riding seal.

6 Claims, 3 Drawing Sheets

SEAL PLATE

BACKGROUND OF THE INVENTION

1. Field of the Invention

The invention concerns a seal plate in the internal air system of a gas turbine engine.

2. Description of Related Art

A gas turbine engine internal air system does not contribute directly to engine thrust but has several important functions to perform for safe and efficient operation of the engine. Chief among these functions is cooling of static and rotary stages including vanes, blades, discs etc, control of turbine tip clearances and prevention of hot gas ingestion into, for example, turbine disc cavities. Up to about one fifth of total engine core mass flow may be diverted into this internal air system through bleed outlet at one or more locations in the compressor system. Consequently work has already been done on air consumed by the internal air system in compressing it. Leakage losses are therefore a total loss to the engine and have a negative effect on thrust and engine efficiency.

Seals between relatively static and rotating engine stages represent escape paths for the system air and ingenuity and effort is directed at reducing such losses in order to mininise the drain of compressed air and as one way of raising engine efficiency. In an internally cooled turbine stage, it is found desirable to have a low-leakage air seal at a high radius, essentially just radially inboard of the turbine disc rim. The seal helps define a plenum chamber bounded on one side by a face of the turbine disc itself from which turbine blade internal cooling air is drawn. In passing through the plenum the air also passes over the disc face and helps cool it.

It has been found advantageous in these circumstances to use an air riding seal or face seal of the kind in which a relatively stationary ring or collar is maintained in close proximity to a relatively rotating face plate. In effect the ring rides on a cushion of air without coming into rubbing contact with the plate maintained by a balance of axially directed forces. In such an arrangement it is necessary to maintain an accurate alignment between the confronting faces of the relatively rotating ring and plate.

SUMMARY OF THE INVENTION

It is an objective of the present invention to solve this by providing a disc mounted seal plate, the mounting arrangement of which is adapted to maintain the required alignment of the seal faces.

According to one aspect of the present invention there is provided an annular seal plate for an interstage air riding seal of a gas turbine engine comprising an annular plate formed with seal surface on one side thereof, and on the opposite face towards a radially inner circumference of the annular plate an annular lip of a first part which is adapted to engage a corresponding feature of a second part on a disc, said first and second parts being formed with faces angled relative to the axial and radial directions of the engine so that when mutually engaged centrifugal forces acting on the plate arc reacted by the disc to tend to maintain an accurate radial alignment of the face of the seal plate.

According to another aspect of the present invention there is provided an interstage air riding seal for the internal cooling system of a gas turbine engine comprises an annular seal member carried on a relatively stationary stage of the engine which is mounted for two degrees of axial movement relative to an annular seal plate carried by an adjacent relatively rotatable disc, the mounting arrangement of the scat plate on the rotatable disc including a first part towards a radially inner circumference of the annular plate which mutually engages a corresponding part on the disc, the mutually engaged faces of said parts being angled relative to the axial and radial directions of the engine so that centrifugal forces acting on the plate are reacted by the disc to tend to maintain an accurate radial alignment of the confronting faces of the plate and the annular seal member.

BRIEF DESCRIPTION OF THE DRAWINGS

The invention and how it may be carried into practice will now be described in greater detail with reference, by way of example, to an embodiment illustrated in the accompanying drawings, in which.

DESCRIPTION OF PREFERRED EMBODIMENT

Figure 1:
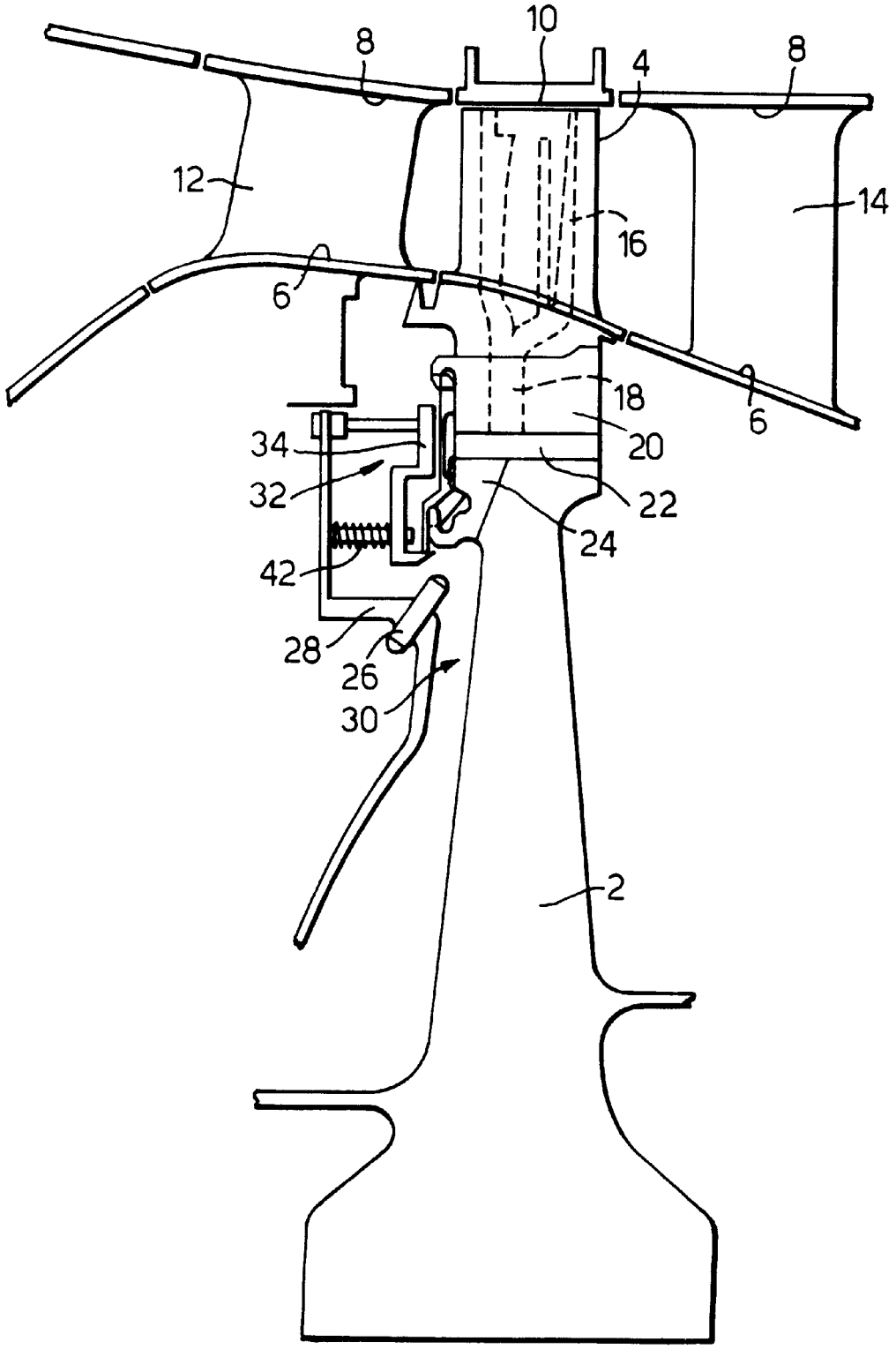
FIG. 1 is a transverse radial section through a turbine stage showing the location of the air riding seal assembly.

FIG. 1 shows a radial section of a first stage high-pressure turbine stage. A rotary turbine disc is indicated at 2, an internally air-cooled turbine blade of which is shown at 4 mounted on the periphery of the disc 2 in conventional manner. The inner and outer gas path walls 6,8 respectively of the turbine section are defined by adjacent platforms of the blade 4, a circumferential array of turbine stage shroud segments 10, and the inner and outer platforms of upstream nozzle guide vanes 12 and of downstream, inter-stage guide vanes 14.

The blades 4 have an internal air cooling arrangement generally indicated by broken lines at 16 which are supplied through a passageway 18 formed through blade roots 20 with high pressure cooling air via bucket grooves 22, formed in the base of root slots in the periphery of disc 2, and slotted air passages 24 formed in the upstream side of the disc rim. The cooling air is directed at the passages 24 in the rotating disc 2 by pre-swirl nozzles 26 carried by a stationary annular chamber wall 28 which is located radially inboard of the nozzle guide vanes 12. The face of disc 2 and the annular wall 28 between them define a pre-swirl chamber 30, the radially outer circumferential region of which is closed by an annular air-riding seal assembly generally indicated at 32.

Figure 2:
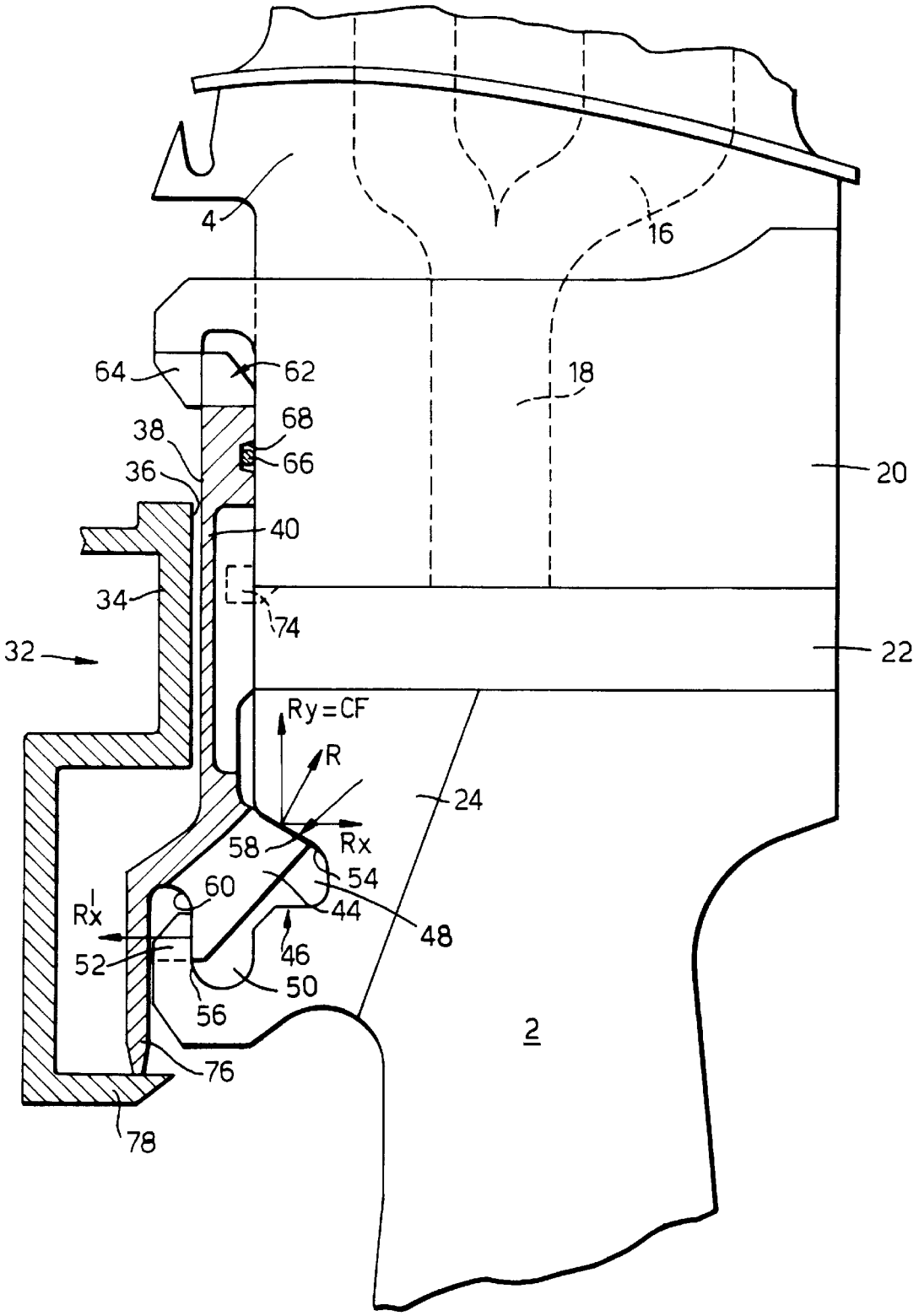
FIG. 2 is a close up view of part of FIG. 1 showing the seal plate and its method of location, and FIGS. 3(*a*), 3(*b*) and 4 are detailed views of a fragment of the annular seal plate of FIGS. 1 and 2.

The air-riding seal assembly 32, shown in greater detail in FIG. 2, includes a non-rotatable, annular seal member 34 which is formed with a flat, annular face 36 which, during engine operation, is maintained at a very close spacing from a correspondingly flat, annular surface 38 on a seal plate 40 carried by and fixed to the rotatable disc 2. Providing a sufficiently close spacing is maintained between the faces 36,38, a cushion of air is created in the shear layers between the faces which effectively functions as a very low leakage seal. One of the principal conditions for maintaining seal effectiveness is that the faces 36,38 must remain parallel at all times with no mutual contact.

The non-rotating seal member 34 is mounted for limited axial movement controlled by a balance of air pressures and a light spring force which is arranged to withdraw the seal member from the seal plate 40 in the absence of air pressure to actuate the seal control arrangement.

In view of the restrictions imposed on the seal surface 38 of seal plate 40 its behavior under operating conditions is critical, in particular the alignment of face 38 parallel to face 36 of the non-rotating seal member is crucial. In the illustrated embodiment the seal faces 36,38 are arranged to be parallel to a radial plane. However, in the dynamic environment of an engine rotating at operational speed problems can arise in maintaining seal face alignment. A particular problem arises due to non-rotational movements of the disc resulting in coning of the seal gap. As mentioned above, the seal member 34 is actuated by differential pressures acting across associated parts of the seal assembly 32 in opposition to a bias force applied by a plurality of springs 42 spaced apart circuniferentially around the seal annulus. This arrangement allows the seal member 34 to track within limits axial movement of the disc 2 but the seal is unable to tolerate substantial divergence (or convergence) of the seal gap. An angular derivation of more than roughly 1.5° can result in rubbing contact between the seal faces, which impairs subsequent seal performance.

The major cause of this divergence of the seal faces is tilting of the annular seal plate 40 carried by the rotating disc 2. The invention is intended to tackle this problem by providing a mounting arrangement for the seal plate 40 which tends to self-align during operation.

Figure 3A:
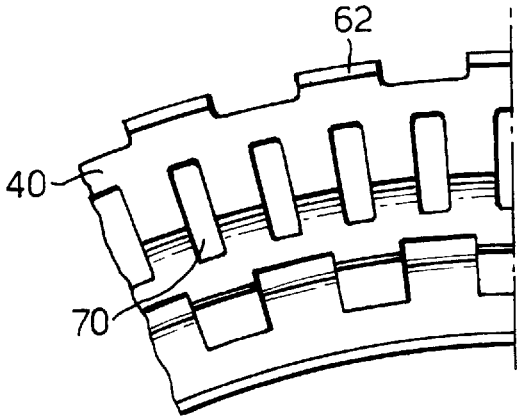
Figure 3B:
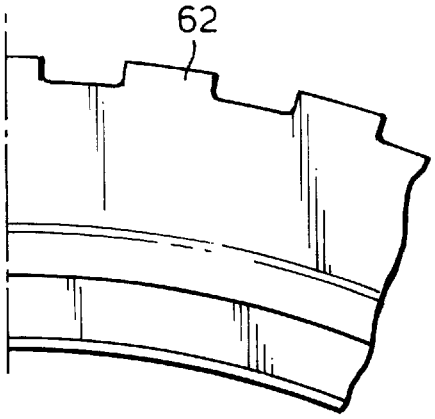
Figure 4:
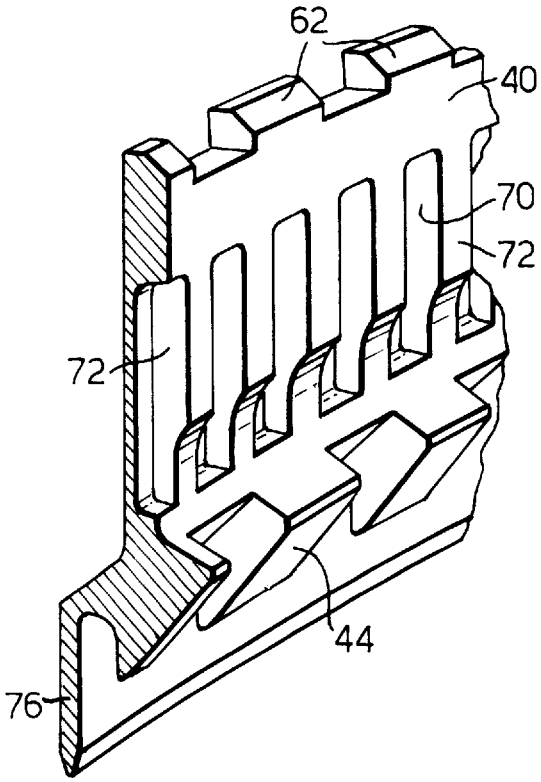

The seal plate 40 is shown in radial section in FIG. 2 and in greater detail in FIGS. 3(*a*), 3(*b*) and FIG. 4. It comprises an annular member the front face of which is formed with the flat, annular seal surface 38. The seal plate mounting arrangement is formed integrally with the plate on its rear face and is engaged with a complimentary formation on the disc to mount the plate. Essentially the radially inner margin of the seal plate 40 is formed with a mortise and tennon like structure consisting of an annular lip or tenon 44 which engages with a groove or mortise formation 46 in the front face of disc 2. Shown best in the section view of FIG. 2 the mortise groove formation 46 comprises two circumferentially extending grooves, the first of which 48 extends substantially axially and the second of which 50 extends radially inwards with a radially outward projecting hook 52 defining one side of the mortise groove formation 46. The radially outermost surface 54 of the axial groove 48 is formed at an oblique angle to the radial and axial directions and acts as a reaction surface. The inward facing surface 56 of the hook 52 lies in a radial plane and also acts as a reaction surface. The tenon lip 44 is formed with complementary reaction side surfaces 58,60 which, when the seal plate is mounted in position engage the mortise reaction surface 54,56 respectively.

The angles and relative position of the reaction surfaces 48,50 on the disc 2 and 58,60 on the seal plate 40 are chosen so that centrifugal loads acting on the seal plate 40 are reacted through to surfaces to ensure, at a chosen design rotational speed, that the seal surface 38 lies exactly in a radial plane. The centrifugal loads effectively straighten the seal plate in a sense to tend to reduce the effect of coning or tilting of disc 2 in operation. The seal plate can be designed with zero tilt angle, relative to a radial plane, when the disc which carries it is at its maximum divergent coning angle.

In operation, with reference to FIG. 2 the load R due to centrifugally generated forces exerted by the tenon lip 44 on the angled mortise groove surface 54 may be resolved into a radial component $R_y$ and an axial component $R_x$. Axial movement of the seal plate in reaction to the axial force $R_x$ is restrained by engagement of the tenon surface 60 with the inner hook surface 56 producing a second axial force component $R'_x$. These two axial force components $R_x$ and $R'_x$ generate a couple which tends to tilt the seal plate so that the radially outer margin of the annular plate is urged against the face of the disc. The outer circumferential margin of the plate, indicated at 62, is engaged by a further inward facing hook 64 formed integrally with the outer circumference of the disc 2. A ring seal 66 may be located in a circumferentially extending groove 68 in the rear face of the seal plate 40, the purpose of which is to stop leakage of cooling air from the bucket grooves 22 between the abutting faces of plate 40 and disc 2.

Since integrity of the seal face 38 is critical to correct functioning of the air riding seal 32, the seal plate 40 is manufactured as a single piece. The method chosen for mounting the plate 40 on the face of disc 2 is by a bayonet fitting. Therefore the annular tenon lip 44 and the disc retaining hook 52 are machined to produce complementary crenelations which may be aligned for mutual engagement and relative rotation. Similarly the seal plate margin 62 and circumferential disc hook 64 are also crenelated for interengagement and rotation. These formations on the seal plate 40 are shown in the view of FIGS. 3(*a*), 3(*b*) and FIG. 4.

Also visible in the views of FIGS. 3(*a*) and 4 are machined pockets or notches 70 in the rear face of the seal plate 40. The primary purpose of these is to reduce the weight of the seal plate. Ribs 72 are left between adjacent notches 70 to retain inherent stiffness in the seal plate 40. In addition, however, they may serve to engage one or more tabs or keys, 74 in FIG. 2, located in the bucket grooves 22 to prevent rotation of the seal plate 40 relative to the disc. The inner circumference of the seal plate 40 may also be formed integrally with an annular aspirator fin 76 which projects radially inwards and which forms part of a fin seal together with a projection 78 carried by the air riding seal 32 for the purpose of controlling pressure differentials in the seal assembly.

I claim:

1. An interstage air riding seal arrangement for an internal cooling system of a gas turbine engine comprising an annular sealing ring mounted on a relatively stationary part of the engine for relative axial movement relative to an annular seal plate carried by a relatively rotatable disc, the seal plate being mounted on the disc by means of a mortise and tenon like mounting arrangement including first mutually engaged reaction surfaces angled relative to axial and radial directions so that, in use, centrifugal forces acting on the seal plate are reacted by the disc in a sense to tend to align a seal face of the seal plate in a radial plane.

2. The seal arrangement as claimed in claim 1, wherein the mortise and tenon like mounting arrangement includes a projecting tip carried by the seal plate which is engaged with a slot or groove formed in the disc.

3. The seal arrangement as claimed in either claim 1, wherein the mounting arrangement further includes second mutually engaged reaction surfaces in a substantially radial plane.

4. The seal arrangement as claimed in claim 3, wherein the first and second mutually engaged thrust faces are spaced whereby, in use, reaction surfaces therefrom form a couple acting on the seal plate in a sense to tend to align the seal face of the plate in a radial plane.

5. The seal arrangement as claimed in claim 1, wherein the seal plate is adapted for bayonet fitting on the disc.

6. The seal arrangement as claimed in claim 5, wherein the mortise and tenon like mounting arrangement comprises interengaging crenelated formations on the disc and seal plate.

* * * * *